US008556475B2

(12) United States Patent
Hochstein

(10) Patent No.: US 8,556,475 B2
(45) Date of Patent: Oct. 15, 2013

(54) SOLAR SHIELD FOR LED LIGHT EMITTING ASSEMBLY

(75) Inventor: Peter A. Hochstein, Troy, MI (US)

(73) Assignee: Relume Technologies, Inc., Oxford, MI (US)

( * ) Notice: Subject to any disclaimer, the term of this patent is extended or adjusted under 35 U.S.C. 154(b) by 200 days.

(21) Appl. No.: 13/322,592

(22) PCT Filed: Jan. 18, 2010

(86) PCT No.: PCT/US2010/021317

§ 371 (c)(1),
(2), (4) Date: Nov. 28, 2011

(87) PCT Pub. No.: WO2010/144154

PCT Pub. Date: Dec. 16, 2010

(65) Prior Publication Data

US 2012/0069571 A1 Mar. 22, 2012

Related U.S. Application Data

(60) Provisional application No. 61/186,101, filed on Jun. 11, 2009.

(51) Int. Cl.
*F21V 33/00* (2006.01)

(52) U.S. Cl.
USPC ..... 362/373; 362/294; 362/457; 362/431; 362/414

(58) Field of Classification Search
USPC ..... 362/458, 457, 249.02, 218, 294, 373, 362/431, 414
See application file for complete search history.

(56) References Cited

U.S. PATENT DOCUMENTS

| | | | | |
|---|---|---|---|---|
| 4,237,521 | A | 12/1980 | Denker | |
| 5,054,545 | A | 10/1991 | Ghaemian | |
| 5,513,071 | A | 4/1996 | LaViolette et al. | |
| 5,894,407 | A | 4/1999 | Aakalu et al. | |
| 5,921,663 | A * | 7/1999 | Flammer | 362/294 |
| 5,986,618 | A | 11/1999 | Aakula et al. | |
| 6,527,422 | B1 | 3/2003 | Hutchison | |
| 7,488,093 | B1 * | 2/2009 | Huang et al. | 362/294 |
| 7,758,207 | B1 * | 7/2010 | Zhou et al. | 362/218 |
| 7,946,737 | B2 * | 5/2011 | Liu | 362/373 |
| 2007/0159827 | A1 * | 7/2007 | Huang | 362/294 |
| 2008/0089071 | A1 * | 4/2008 | Wang | 362/294 |
| 2008/0211369 | A1 | 9/2008 | Zhang et al. | |
| 2008/0298069 | A1 | 12/2008 | Chu | |
| 2010/0073943 | A1 * | 3/2010 | Yeh et al. | 362/373 |

FOREIGN PATENT DOCUMENTS

WO PCT/US2008/065874 5/2008

* cited by examiner

*Primary Examiner* — Laura Tso
(74) *Attorney, Agent, or Firm* — Dickinson Wright PLLC

(57) ABSTRACT

An L.E.D. light emitting assembly (20) includes an aluminum heat sink (22) presenting a mounting surface (24) with light emitting diodes (26) disposed thereon. A thermoplastic housing (28) is disposed over the heat sink (22) and presents a top surface (30) facing outwardly. An electronics enclosure (32) is disposed on the top surface (30). A solar shield (34) extends over and spaced from the electronics enclosure (32). The solar shield (34) includes a closed solar top wall (102) and solar side walls (104). The solar shield (34) defines an air inlet (114) adjacent a lower edge (112) of each of the solar side walls (104) and an air outlet (116) above the air inlet (114) at open solar ends (108) thereof for creating a chimney effect to move ambient air into the air inlet (114) and through an air flow space (111) to exit the air outlet (116).

11 Claims, 4 Drawing Sheets

SOLAR SHIELD FOR LED LIGHT EMITTING ASSEMBLY

CROSS REFERENCE TO RELATED APPLICATION

This application claims the benefit of application Ser. No. 61/186,101 filed Jun. 11, 2009.

BACKGROUND OF THE INVENTION

1. Field of the Invention

The subject invention relates to a light emitting assembly of the type including light emitting diodes (L.E.D.s), and more particularly, reducing temperatures to prolong the service life of the L.E.D. light emitting assembly.

2. Description of the Prior Art

Light assemblies including L.E.D.s are often preferred over other light assembles due to their high efficiency. At least a fifty percent (50%) energy savings is possible when light assemblies including most high intensity discharge (H.I.D.) lights are replaced with properly designed L.E.D. light assemblies. An example of such an L.E.D. light assembly is disclosed in P.C.T. Patent Application Serial No. PCT/US2008/65874 to the present inventor, Peter A. Hochstein, which is directed to effective thermal management of an L.E.D. light emitting assembly. The '874 application discloses a heat sink presenting a mounting surface and an oppositely facing heat transfer surface and a plurality of light emitting diodes disposed on the mounting surface. The '874 application also discloses a housing disposed over the heat sink and presenting a top surface facing outwardly. Such L.E.D. light assemblies typically have a service life of about 70,000 hours.

Like most electrical assemblies, L.E.D. light emitting assemblies typically include electronics enclosures for covering a power supply and other electrical components. The electronic enclosure may be disposed on the top surface of the housing. However, the electrical components of L.E.D. light emitting assemblies are particularly subject to thermal damage, and are rarely designed to exceed 85° C. For example, when the electronics enclosure of an L.E.D. light emitting assembly is exposed to sunlight with a nominal radiant flux of 1000 W/m$^2$ with an ambient air temperature of 20° C., the measured temperature inside the electronics enclosure typically exceeds 85° C., which causes the electrical components housed therein to fail before the light emitting diodes. Further, most geographical regions of the continental United States are subject to a solar flux of nominally 1,000 W/m$^2$, which causes an electronics enclosure of even modest dimensions to absorb over 200 W of heat under direct sunlight.

One approach used to reduce the temperature inside the electronics enclosure includes venting the electronics enclosure. However, this approach is not practical because the electronics enclosure should be sealed against moisture, dirt, insects, and corrosive elements, such as salt or vehicle emissions, to maintain reliable operation.

Another approach used to reduce the temperature inside an electronics enclosure includes extending a solar shield over the electronics enclosure. An example of such a solar shield is disclosed in U.S. Pat. No. 5,986,618, in the name of Aakula et. al., and assigned to Lucent Technologies, Inc. The '618 patent discloses a solar shield having a continuous and closed solar top wall extending between solar ends and solar sides. The solar top wall of the '618 patent extends over and is spaced from the electronics enclosure to create a space therebetween.

The solar shield of the '618 patent includes solar side walls depending from each of the solar sides to lower edges. Although the solar shield disclosed in the '618 patent blocks solar light from the electronics enclosure, the measured temperature inside the electronics enclosure is high.

SUMMARY OF THE INVENTION

The subject invention provides such an L.E.D. light emitting assembly including a solar shield defining an air inlet disposed adjacent a lower edge of each solar side wall of the solar shield and an air outlet disposed above the air inlet at least one solar end thereof for creating a chimney effect to move ambient air into the air inlet and through a space between the electronics enclosure and solar shield to exit the air outlet.

ADVANTAGES OF THE INVENTION

The solar shield of the subject invention provides for convective cooling of the electronics enclosure by allowing cool ambient air to enter the solar shield through the air inlet, rise and travel through the space between the hot electronics enclosure and the solar side walls, and escape through the air outlet. The space between the solar shield and the electronics enclosure allows for free movement and circulation of the convected air. This chimney effect may provide a temperature reduction inside the electronics enclosure of more than 33° C. As alluded to above, when an L.E.D. light assembly including the electronics enclosure with a top wall of 250×600 mm is subjected to 1000 W/m$^2$ (1 sun) and an ambient temperature of 20° C. without the solar shield of the subject invention, temperatures inside the electronics enclosure exceed 87° C. However, when the solar shield of the subject invention, defining the air inlet and air outlet, extends over and is spaced from the enclosure cover, the temperature inside the electronics enclosure is reduced to about 54° C. Even when the surface temperature of the solar shield exceeds 100° C., the temperature inside the electronics enclosure remains close to 54° C. Accordingly, the subject invention provides a low cost approach to prolonging the service life of L.E.D. light emitting assemblies.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
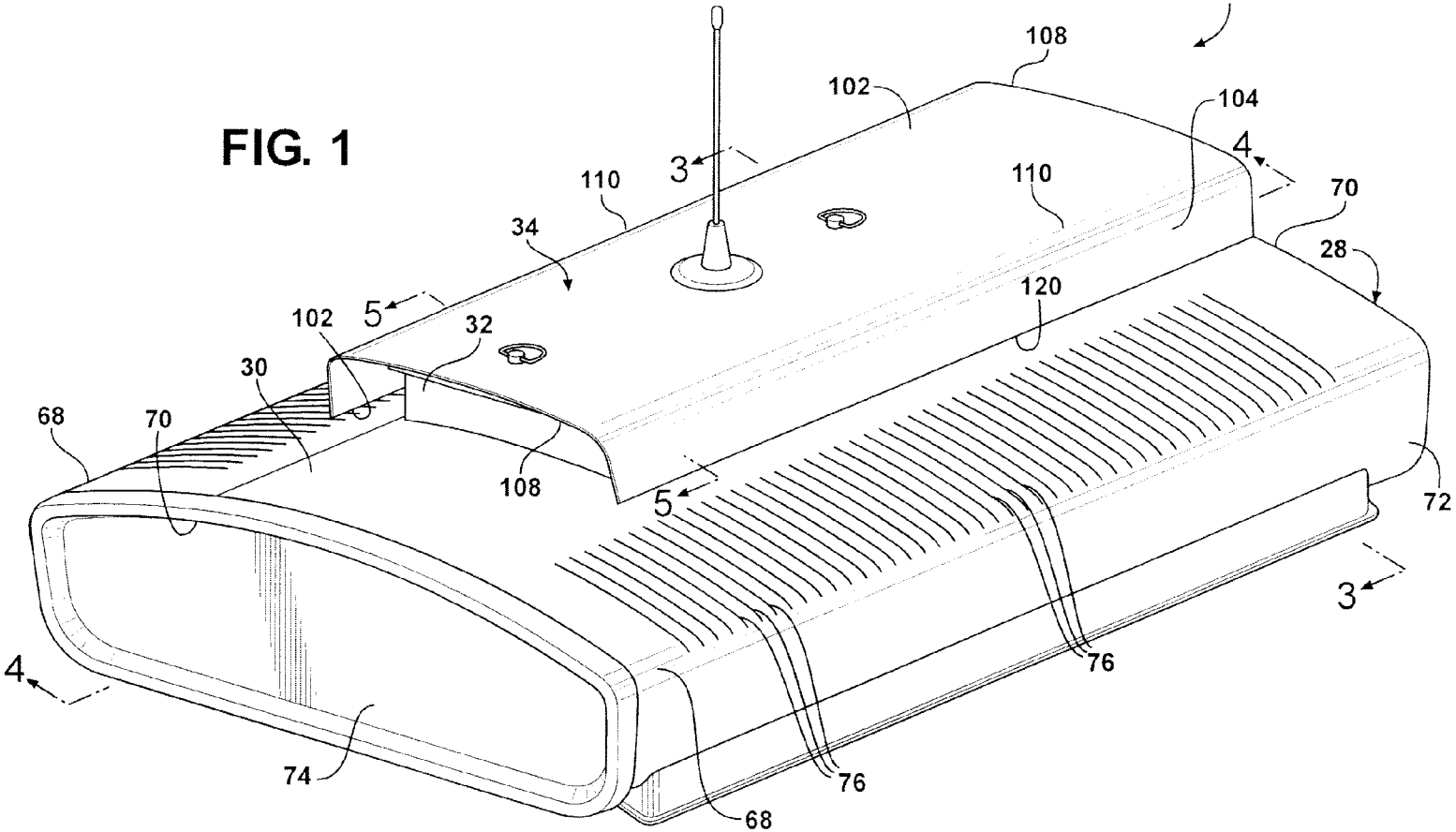
FIG. 1 is a perspective top view of a preferred embodiment of an L.E.D. light emitting assembly showing the solar shield.

Referring to the Figures, an L.E.D. light emitting assembly 20 is generally shown. The light emitting assembly 20 includes a heat sink 22 presenting a mounting surface 24. A plurality of light emitting diodes 26 are disposed on the mounting surface 24. A housing 28 covers the heat sink 22 and presents a top surface 30 facing outwardly. An electronics enclosure 32 is disposed on the top surface 30 of the housing 28. A solar shield 34 extends over and is spaced from the electronics enclosure 32. The solar shield 34 defines air inlet 114 and an air outlet 116 for creating a chimney effect to move ambient air through the light emitting assembly 20.

Figure 2:
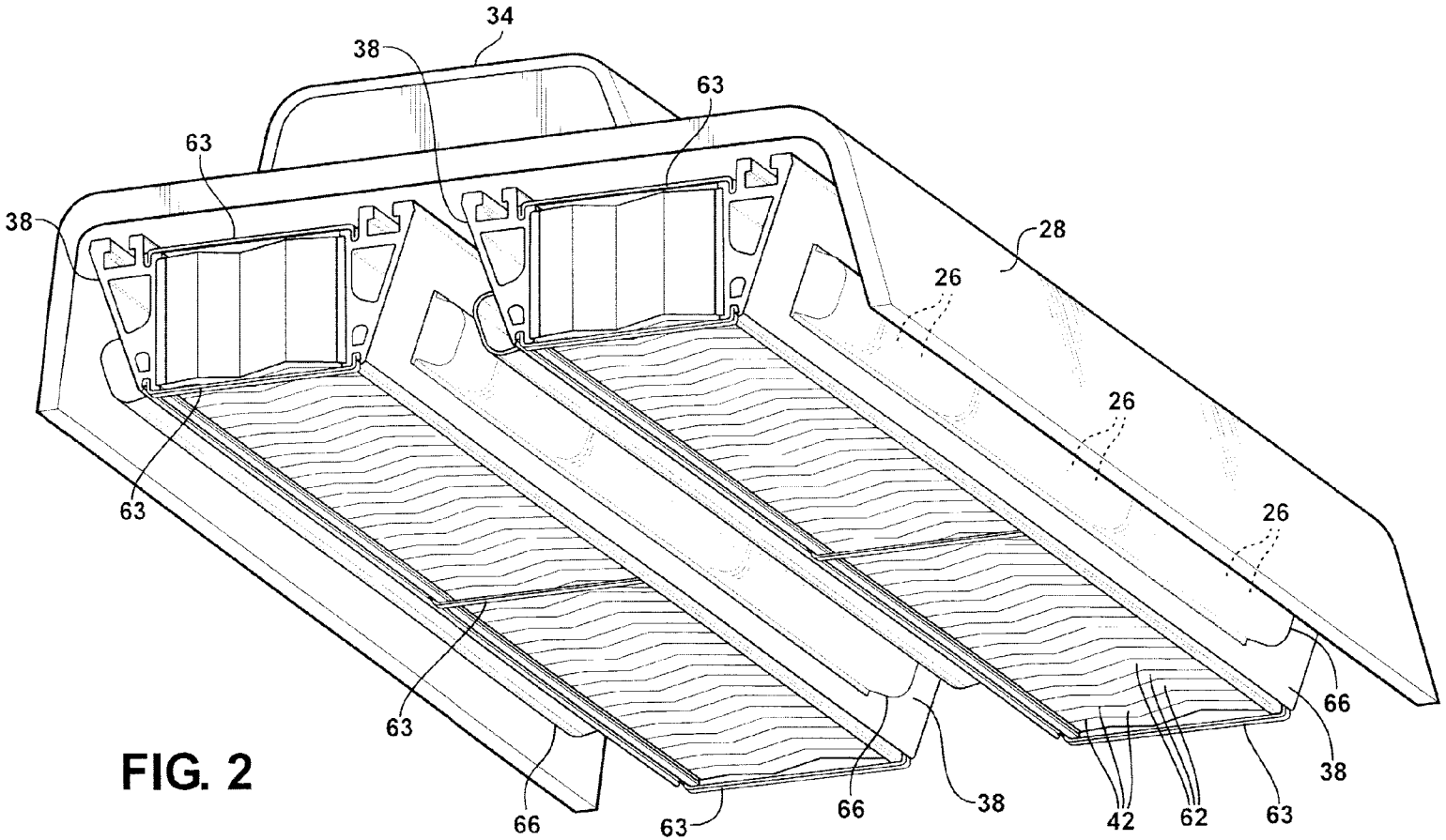
FIG. 2 is a perspective bottom view of the L.E.D. light emitting assembly showing the heat sink, light emitting diodes, and mounting arm.
Figure 3:
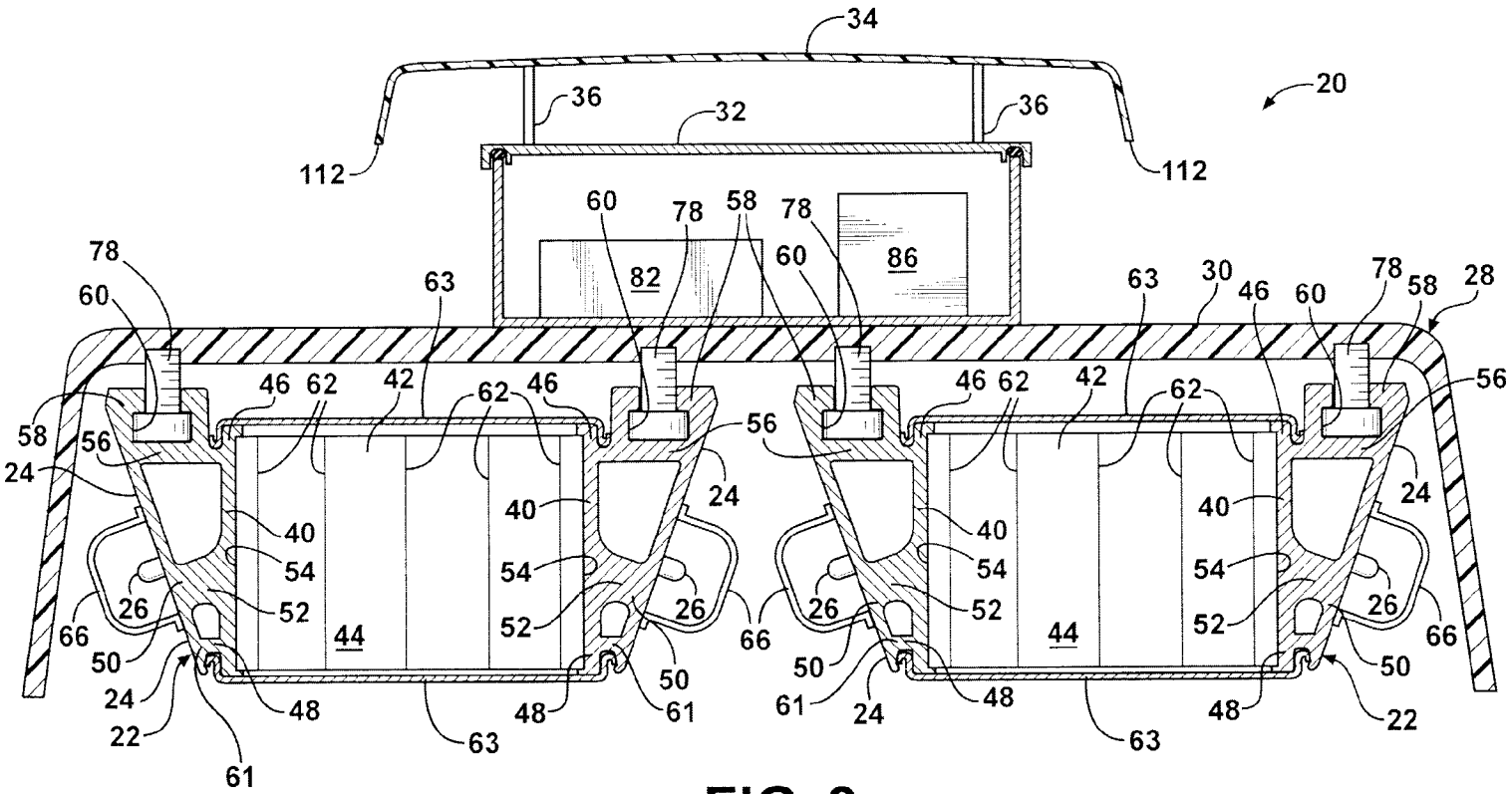
FIG. 3 is a cross-sectional view of the L.E.D. light emitting assembly of FIG. 1 along line 3-3.
Figure 6:
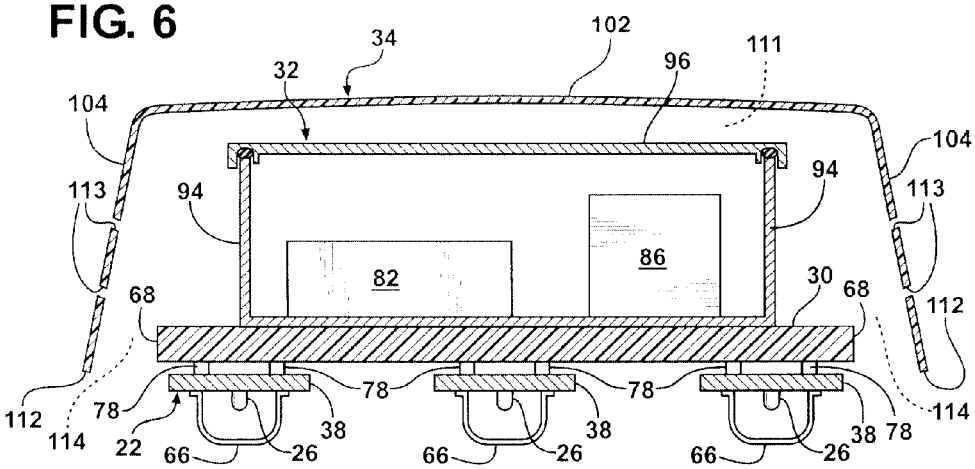
FIG. 6 is a cross sectional view of an alternate embodiment of the L.E.D. light emitting assembly showing the solar top wall disposed over the entire top surface of the housing and an alternate heat sink design.

The light emitting assembly 20 includes the heat sink 22 of electrically insulating and thermally conductive aluminum material presenting the mounting surface 24. The heat sink 22 includes a plurality of elongated sections 38 independent of one another, as shown in FIGS. 2, 3, and 6. In the embodiment shown in FIGS. 2 and 3, each light emitting assembly 20 typically includes two pairs of the elongated sections 38. The elongated sections 38 are mirror images of one another in cross section. Each elongated section 38 presents a fin wall 40 spaced and parallel to one another to define a fin space 44 therebetween, and each fin wall 40 has an upper side edge 46 and a lower side edge 48, as shown in FIG. 3. An LED wall 50 is spaced from the fin wall 40 of each elongated section 38. A heat transfer web 52 connects the LED wall 50 to the fin wall 40 for transferring heat from the LED wall 50 to the fin wall 40. The LED wall 50 of each elongated section 38 presents the mounting surface 24 facing outwardly and a heat transfer surface 54 facing inwardly toward the fin wall 40.

An upper truss member 56 connects the fin wall 40, below the upper side edge 46, to the LED wall 50 of each elongated section 38. The upper truss member 56 spaces the upper side edge 46 of the fin wall 40 further from the LED wall 50 than the lower side edge 48 of the fin wall 40, as shown in FIG. 3. Each of the elongated sections 38 also includes an attachment block 58 extending along the upper truss member 56. The attachment block 58 defines an attachment slot 60 extending into and continuously along the attachment block 58 for mounting the heat sink 22. An upper strap slot is defined between the attachment block 58 and the fin wall 40, as shown in FIGS. 2 and 3. A lower truss member 61 connects the fin wall 40 to the heat transfer surface 54 of the LED wall 50 above the lower side edge 48 to space the heat transfer surface 54 from the fin wall 40. The lower truss member 61 defines a lower strap slot, as shown in FIGS. 2 and 3.

The heat sink 22 also includes a plurality of fins 42 disposed in spaced and parallel relationship to one another and extending in width across the fin 42 space 44 between the fin walls 40 of each of the pairs of the elongated sections 38, as shown in FIG. 2. Each of the fins 42 include a plurality of bends 62 extending across the fin space.

The light emitting assembly also includes a plurality of straps 63 extending across the fin space 44 between the elongated sections 38 to clamp the fins 42 between the elongated sections 38, as shown in FIGS. 2 and 3. The straps 63 are typically formed of a high strength metal, such as stainless steel, and include U-shaped catches at the ends thereof. The straps 82 extend across the fin space 44 between and over the lower side edges 48 of the spaced fin walls 40, and the catches of the straps 63 are wedged into the lower strap slots to hold each of the elongated sections 38 together, as shown in FIGS. 2 and 3. The straps 63 also extend across the fin space 44 between and over the upper side edges 46 of the spaced fin walls 40 and the catches thereof are wedged into the upper strap slots. Alternatively, the heat sink 22 may include another configuration, such as a casting.

The plurality of light emitting diodes 26 are disposed on the mounting surface 24 of each elongated section 38. The light emitting diodes 26 are disposed spaced and parallel to one another, and a row of the light emitting diodes 26 extends along the mounting surface 24 of each elongated section 38. An independent elongated cover 66 is disposed on the mounting surface 24 of each elongated section 38 and covers one of the rows of light emitting diodes 26.

As shown in FIG. 3, the light emitting assembly 20 includes the housing 28 disposed over and coupled to the heat sink 22. The housing 28 presents a top surface 30 facing outwardly and away from the heat sink 22. The top surface 30 of the housing 28 presents housing side edges 68 extending between opposite housing end edges 70. Housing side walls 72 extend downwardly from the housing side edges 68 and housing end walls 74 extend downwardly from the housing side edges 68 to frame the heat sink 22. The housing 28 includes a plurality of perforations 76, as shown in FIG. 1, disposed adjacent the housing side edges 68 for allowing hot air shed from the heat sink 22 to escape therethrough.

The housing 28 is typically formed of a thermoplastic, vacuum formed, polyester [TPO] material, a molded polycarbonate, or a metal material such as stainless steel or powder coated aluminum, for corrosion protection. The housing 28 is designed to shield the heat sink 22 from precipitation, debris, and other harmful effects detrimental to the assembly's 20 operation. The housing 28 also shields the heat sink 22 from sunlight, which reduces the temperature of the heat sink 22 and light emitting diodes 26.

The housing 28 and heat sink 22 are coupled to one another by a plurality of attachments 78, as shown in FIG. 3. The attachments 78 are disposed in the attachment slots 60 of the heat sink 22. The attachments 78 extend transversely from the heat sink 22 and into the top surface 30 of the housing 28. The attachments 78 may include bolts, clips, screws, or other another type of connector.

As shown in FIGS. 3-6, a plurality of electrical components 82, 84, 86, 88, 90 are disposed on the top surface 30 of the housing 28. The electrical components 82, 84, 86, 88, 90) include a power supply 82 for supplying power to the light emitting diodes 26; an electrical connection block 84 electrically coupling the power supply 82 and the light emitting diodes 26; a light control 86 for controlling the power supplied to the light emitting diodes 26; and a radio transceiver 88 for transmitting and receiving radio signals including data to control the power supplied to the light emitting diodes 26. The radio transceiver 88 transmits the data to the light control 86, and the light control 86 uses the data to supply a predetermined amount of power to the light emitting diodes 26. The radio transceiver 88 is also electrically coupled to a radio antenna 90. The radio antenna 90 is disposed atop the radio transceiver 88 for transmitting and receiving radio signals to and from the remote controller, and for conveying the radio signals to the radio transceiver 88.

The electronics enclosure 32 is also disposed on the top surface 30 for housing 28 the electrical components 82, 84, 86, 88, 90, as shown in FIGS. 1 and 3-6. The electronics enclosure 32 includes enclosure end walls 92 extending upwardly from the top surface 30 of the housing 28 and enclosure side walls 94 extending upwardly from the top surface 30 between the enclosure end walls 92 to frame the electrical components 82, 84, 86, 88, 90. The electronics enclosure 32 includes an enclosure top wall 96 extending parallel to the top surface 30 and continuously between the enclosure side walls 94 and the enclosure end walls 92 and over the electrical components 82, 84, 86, 88, 90 to define an enclosed space 44 around the electrical components 82, 84, 86, 88, 90. In one embodiment, the enclosure top wall 96 has an exposed area of 250×600 mm, but may have another dimension. The enclosure top wall 96 defines an antenna opening for allowing the radio antenna 90 to pass therethrough and upwardly from the enclosure. The enclosure top wall 96 is typically sealed along the antenna opening so that the enclosure top wall 96 remains continuous and closed. The electronics enclosure 32 is formed of die cast or stamped aluminum or a painted or plated sheet metal material. A seal 98, such as a rubber gasket, is disposed between each of the enclosure walls 92, 94, 96 and along the antenna opening for sealing the electronics enclosure 32 around the electrical components 82, 84, 86, 88, 90. The sealed electronics enclosure 32 protects the electrical components 82, 84, 86, 88, 90 from ambient air, precipitation, moisture, insects, debris, vehicle emissions, salt, and other harmful elements.

Figure 4:
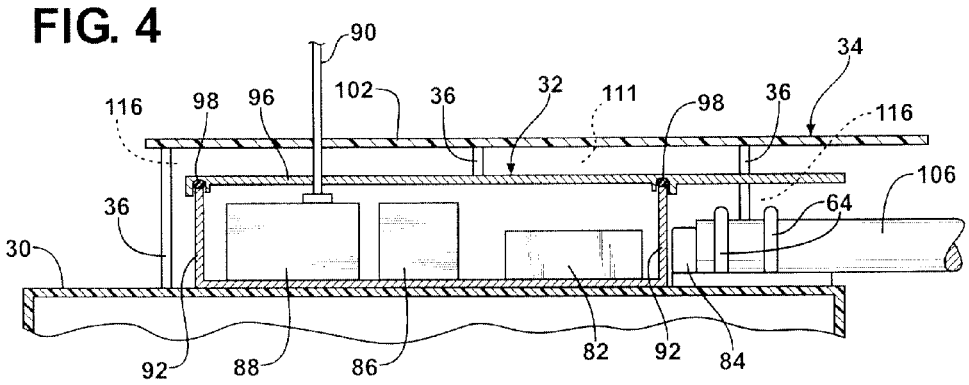
FIG. 4 is a cross sectional view of the L.E.D. light emitting assembly of FIG. 1 along line 4-4.

A mounting arm 106 extends transversely away from the electronics enclosure 32, as shown in FIG. 2. The mounting aim 106 is coupled to the top surface 30 of the housing 28 by a mounting arm clamp 64, which engages both the top surface 30 and the mounting arm 106, as shown in FIG. 4. The light emitting assembly 20 may be mounted to a separate support structure, such as a street lamp post or a planar surface, in a variety of configurations. The mounting arm 106 may extend transversely from the support structure so that the light emitting assembly 20 is positioned to direct light in a predetermined direction toward the ground. The mounting arm 106 may also extend from the support structure at an angle relative to the ground, so that the light emitting assembly 20 is positioned to direct light in another predetermined direction.

The solar shield 34 extends over the electronics enclosure 32 to shield the electronics enclosure 32 and the electrical components 82, 84, 86, 88, 90 from solar light and heat. The solar shield 34 is formed of a light reflective sheet metal material, such as an aluminum alloy or steel. The solar shield 34 typically has a continuous and closed solar top wall 102 extending between solar ends 108 and solar sides 110 and over and spaced from the electronics enclosure 32 to create an air flow space 111 therebetween. In the embodiment wherein the enclosure top wall 96 has an exposed area of 250×600 mm, the solar shield 34 is spaced nominally 8 mm from the electronics enclosure 32, but the solar shield 34 may be spaced another distance from the electronics enclosure 32. The solar ends 108 are generally parallel to the enclosure end walls 92, and the solar sides 110 are generally parallel to the enclosure side walls 94. The solar top wall 102 defines an antenna opening for allowing the radio antenna 90 to pass therethrough and upwardly from the solar top wall 102. The solar top wall 102 is sealed along the antenna opening so that the solar top wall 102 may remain continuous and closed. The solar shield 34 includes a solar side wall 104 depending from each of the solar sides 110 to lower edges 112. The solar side walls 104 are canted at a slight angle relative to the solar top wall 102 and away from the electronics enclosure 32. The solar side walls 104 extend continuously and closed between the solar ends 108 and from the solar sides 110 of the solar top wall 102 to the lower edges 112 to prevent air flow through the solar side walls 104. The solar top wall 102 protects the enclosure top wall 96 and the solar side walls 104 protect the enclosure side walls 94 from solar light and heat. In one alternative embodiment, the solar top wall 102 has perforations 113 allowing air to flow therethrough, as shown in FIG. 6.

Figure 5:
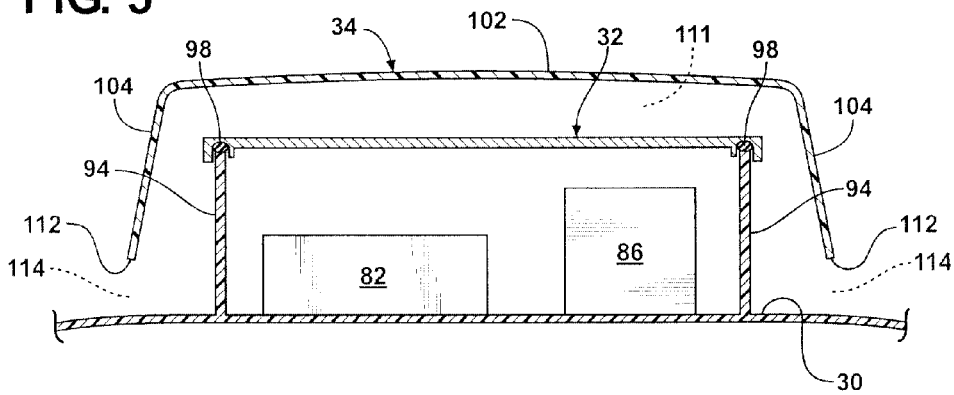
FIG. 5 is a cross sectional view of the L.E.D. light emitting assembly of FIG. 1 along line 5-5.

The solar shield 34 defines the air inlet 114 disposed adjacent the lower edge 112 of each of the solar side walls 104, as shown in FIG. 5. The lower edges 112 of the solar side walls 104 are spaced from the electronics enclosure 32 and from the top surface 30 to define the air inlets 114. The solar shield 34 also defines the air outlet 116 disposed above the air inlet 114 at least one of the solar ends 108 thereof, as shown in FIG. 4 The solar top wall 102 terminates at least one of the solar ends 108 thereof to present one totally open air outlet 116 at the open solar end 108 between the solar side walls 104 of the solar shield 34. An end cap may be disposed over one of the ends of the solar shield 34. The solar top wall 102 typically terminates at both solar ends 108 thereof to present one totally open air outlet 116 at each open solar end 108 between the solar side walls 104. The air inlet 114 and air outlet 116 create a chimney effect to move ambient air into the air inlet 114 and through the air flow space 111 to exit the air outlet 116. Cool ambient air enters the solar shield 34 through the air inlet 114, rises, and travels through the air flow space 111 between the hot electronics enclosure 32 and the solar side walls 104, and escapes through the air outlet 116. The air flow space 111 between the solar shield 34 and the electronics enclosure 32 allows for free movement and circulation of the convected air.

In one embodiment, as shown in FIGS. 1-3 and 5, the solar side walls 104 may be disposed above the top surface 30 of the housing 28 so that the air inlet 114 is disposed between the lower edges 112 and the top surface 30. In another embodiment, as shown in FIG. 6, the solar sides 110 extend past the housing side edges 68 and the solar ends 108 extend past the housing end edges 70 so that the solar top wall 102 fully covers the top surface 30 of the housing 28.

The light emitting assembly 20 includes a spacer 36 extending downwardly from the solar shield 34 for supporting the solar shield 34 over the electronics enclosure 32 and the top surface 30 of the housing 28. The spacer 36 extends continuously from the solar top wall 102 to the top surface 30 of the housing. The spacer 36 may include a plurality of posts, as shown in FIG. 4. Alternatively, the spacer 36 may include a single planar surface, or another structure. The spacer 36 may be separate from or integral with the solar shield 34. The spacer 36 also presents an opening allowing the mounting arm 106 to extend therethrough.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover 66 any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

The invention claimed is:

1. A light emitting assembly (20) comprising:

a heat sink (22) presenting a mounting surface (24), a plurality of light emitting diodes (26) disposed on said mounting surface (24), a housing (28) disposed over said heat sink (22) and presenting a top surface (30) facing outwardly, an electronics enclosure (32) disposed on said top surface (30) of said housing (28), a solar shield (34) having a solar top wall (102) extending between solar ends (108) and solar sides (110) and over and spaced from said electronics enclosure (32) to create an air flow space (111) therebetween, said solar shield (34) including a solar side wall (104) depending from each of said solar sides (110) to lower edges (112), and characterized by, said solar shield (34) defining an air inlet (114) disposed adjacent said lower edge (112) of each of said solar side walls (104) and an air outlet (116) disposed above said air inlet (114) at least one of said solar ends (108) thereof for creating a chimney effect to move ambient air into said air inlet (114) and through said air flow space (111) to exit said air outlet (116).

2. A light emitting assembly (20) as set forth in claim 1 wherein said solar side walls (104) extend continuously and closed between said solar ends (108) and from said solar sides (110) of said solar top wall (102) to said lower edges (112) to prevent air flow through said solar side walls (104), and said lower edges (112) of said solar side walls (104) are spaced from said electronics enclosure (32) and said top surface (30) of said housing (28) to define said air inlets (114).

3. A light emitting assembly (20) as set forth in claim 1 wherein said solar top wall (102) terminates at said solar ends (108) thereof to present one totally open air outlet (116) at each open solar end (108) between said solar side walls (104) of said solar shield (34).

4. A light emitting assembly (20) as set forth in claim 1 wherein said top surface (30) of said housing (28) presents housing side edges (68) extending between opposite housing end edges (70), and said lower edges (112) of said solar side walls (104) are spaced over and above said top surface (30) of said housing (28) and inwardly of said housing side edges (68).

5. A light emitting assembly (20) as set forth in claim 1 wherein said top surface (30) of said housing (28) presents housing side edges (68) extending between opposite housing end edges (70), and said lower edges (112) of said solar side walls (104) are spaced outwardly of said housing side edges (68).

6. A light emitting assembly (20) as set forth in claim 1 wherein said top surface (30) of said housing (28) presents housing side edges (68) extending between opposite housing end edges (70), and said housing (28) includes housing side walls (72) extending downwardly from said housing side edges (68) and housing end walls (74) extending downwardly from said housing side edges (68) to frame said heat sink (22).

7. A light emitting assembly (20) as set forth in claim 1 including at least one spacer (36) extending downwardly from said solar shield (34) for supporting said solar shield (34) over and spaced from said electronics enclosure (32).

8. A light emitting assembly (20) comprising:

a heat sink (22) presenting a mounting surface (24), a plurality of light emitting diodes (26) disposed on said mounting surface (24), a housing (28) disposed over and coupled to said heat sink (22) and presenting a top surface (30) facing outwardly, an electronics enclosure (32) disposed on said top surface (30) of said housing (28), a solar shield (34) having a continuous and closed solar top wall (102) extending between solar ends (108) and solar sides (110) and over and spaced from said electronics enclosure (32) to create an air flow space (111) therebetween, said solar shield (34) including a solar side wall (104) depending from each of said solar sides (110) to lower edges (112), said solar shield (34) including a solar side wall (104) depending from each of said solar sides (110) to lower edges (112), said solar shield (34) defining an air inlet (114) disposed adjacent said lower edge (112) of each of said solar side walls (104) and an air outlet (116) disposed above said air inlet (114) at least one of said solar ends (108) thereof for creating a chimney effect to move ambient air into said air inlet (114) and through said air flow space (111) to exit said air outlet (116), said solar side walls (104) extending continuously and closed between said solar ends (108) and from said solar sides (110) of said solar top wall (102) to said lower edges (112) to prevent air flow through said solar side walls (104), said lower edges (112) of said solar side walls (104) being spaced from said electronics enclosure (32) and said top surface (30) of said housing (28) to define said air inlets (114), and at least one spacer (36) extending downwardly from said solar shield (34) for supporting said solar shield (34) over said electronics enclosure (32).

9. A light emitting assembly (20) comprising:

a heat sink (22) of electrically insulating and thermally conductive aluminum material presenting said mounting surface (24), said heat sink (22) including a plurality of elongated sections (38) independent of one another, said plurality of elongated sections (38) including pairs of said elongated sections (38) being mirror images of one another in cross section and presenting fin walls (40) spaced and parallel to one another to define a fin space (44) therebetween with each fin wall (40) having an upper side edge (46) and a lower side edge (48), each of said elongated sections (38) presenting an LED wall (50) spaced from said fin wall (40) and including a heat transfer web (52) connecting said LED wall (50) to said fin wall (40) for transferring heat from said LED wall (50) to said fin wall (40), each of said LED walls (50) presenting a mounting surface (24) facing outwardly and a heat transfer surface (54) facing inwardly toward said fin wall (40), each of said elongated sections (38) including an upper truss member (56) connecting said fin wall (40) below said upper side edge (46) to said LED wall (50) to space said upper side edge (46) of said fin wall (40) further from said LED wall (50) than said lower side edge (48) of said fin wall (40), each of said elongated sections (38) including an attachment block (58) extending along said upper truss member (56) and defining an attachment slot (60) extending into and continuously along said attachment block (58) for mounting said heat sink (22), a plurality of fins (42) disposed in spaced and parallel relationship to one another and extending in width across said fin space (44) between said fin walls (40) of each of said pairs of said elongated sections (38), each of said fins (42) including a plurality of bends (62) extending between said fin walls (40) of said elongated section (38), a plurality of straps (63) extending across said fin space (44) between each pair of elongated sections (38) to clamp said fins (42) between said elongated sections (38), a plurality of light emitting diodes (26) disposed on said mounting surface (24) of each of said elongated sections (38), said light emitting diodes (26) being spaced and parallel to one another, an elongated cover (66) disposed on said mounting surface (24) of each of said elongated sections (38) and covering said light emitting diodes (26), a housing (28) disposed over and coupled to said heat sink (22) and presenting a top surface (30) facing outwardly, said top surface (30) of said housing (28) presenting housing side edges (68) extending between opposite housing end edges (70), said housing (28) including housing side walls (72) extending downwardly from said housing side edges (68) and housing end walls (74) extending downwardly from said housing side edges (68) frame said heat sink (22), said top surface (30) of said housing (28) defining a plurality of perforations (76) for allowing ambient air to flow therethrough, a plurality of attachments (78) disposed in said attachment slots (60) of said heat sink (22) and extending transversely from said heat sink into said top surface (30) of said housing (28) for coupling said heat sink (22) and said housing (28), a plurality of electrical components (82, 84, 86, 88, 90) disposed on said top surface (30) of said housing (28), said electrical components (82, 84, 86, 88, 90) including a power supply (82) for supplying power to said light emitting diodes (26), said electrical components (82, 84, 86, 88, 90) including an electrical connection block (84) electrically coupling said power supply (82) and said light emitting diodes (26), said electrical components (82, 84, 86, 88, 90) including a light control (86) for controlling the power supplied to said light emitting diodes (26), said electrical components (82, 84, 86, 88, 90) including a radio transceiver (88) for transmitting and receiving radio signals including data from a remote controller and sending the data to said light control (86), said electrical components (82, 84, 86, 88, 90) including a radio antenna (90) disposed atop said radio transceiver (88) for transmitting and receiving radio signals to and from the remote controller, said radio antenna (90) being electrically coupled to said radio transceiver (88) for conveying the radio signals to said radio transceiver (88), an electronics enclosure (32) disposed on said top surface (30) of said housing (28) for covering said electrical components (82, 84, 86, 88, 90), said electronics enclosure (32) including enclosure end walls (92) extending upwardly from said top surface (30) of said housing (28)

said electronics enclosure (32) including enclosure side walls (94) extending upwardly from said top surface (30) between said enclosure end walls (92) to frame said electrical components (82, 84, 86, 88, 90), said electronics enclosure (32) including an enclosure top wall (96) extending parallel to said top surface (30) and continuously between said enclosure side walls (94) and said enclosure end walls (92) and over said electrical components (82, 84, 86, 88, 90) to define an enclosed space around said electrical components (82, 84, 86, 88, 90), said enclosure top wall (96) defining an antenna opening for allowing said radio antenna (90) to pass therethrough and upwardly from said enclosure top wall (96), said electronics enclosure (32) being formed of a die cast aluminum material, a seal (98) disposed between each of said enclosure walls (92, 94, 96) for sealing said electronics enclosure (32) around said electrical components (82, 84, 86, 88, 90), a mounting arm (106) coupled to said top surface (30) of said housing (28) and extending transversely away from said electronics enclosure (32), at least one mounting arm clamp (64) coupling said mounting arm (106) and said top surface (30), a solar shield (34) having a continuous and closed solar top wall (102) extending between solar ends (108) and solar sides (110) and over and spaced from said electronics enclosure (32) to create an air flow space (111) therebetween, said solar shield (34) defining an antenna opening for allowing said radio antenna (90) to pass therethrough and upwardly from said solar top wall (102), said solar ends (108) being generally parallel to said enclosure end walls (92), said solar sides (110) being generally parallel to said enclosure side walls (94), said solar shield (34) including a solar side wall (104) depending from each of said solar sides (110) to lower edges (112), said solar side walls (104) being canted at an angle relative to said solar top wall (102) and away from said electronics enclosure (32), said solar shield (34) defining an air inlet (114) disposed adjacent said lower edge (112) of each of said solar side walls (104) and an air outlet (116) disposed above said air inlet (114) at least one of said solar ends (108) thereof for creating a chimney effect to move ambient air into said air inlet (114) and through said air flow space (111) to exit said air outlet (116), said solar top wall (102) terminating at one of said solar ends (108) thereof to present one totally open air outlet (116) at said open solar end (108) between said solar side walls (104) of said solar shield (34), said solar side walls (104) extending continuously and closed between said solar ends (108) and from said solar sides (110) of said solar top wall (102) to said lower edges (112) to prevent air flow through said solar side walls (104), said lower edges (112) of said solar side walls (104) being spaced from said electronics enclosure (32) and said top surface (30) of said housing (28) to define said air inlets (114), said solar shield (34) being formed of a light reflective sheet metal material, a spacer (36) extending downwardly from said solar shield (34) for supporting said solar shield (34) over said electronics enclosure (32) and said top surface (30) of said housing (28), said spacer (36) extending continuously from said solar top wall (102) to said top surface (30), and said spacer (36) presenting a first opening allowing said mounting arm (106) to extend therethrough.

10. A light emitting assembly (20) as set forth in claim 9 wherein said lower edges (112) of said solar side walls (104) are disposed above said top surface (30) of said housing (28) so that said air inlet (114) is disposed between said lower edges (112) and said top surface (30) of said housing (28).

11. A light emitting assembly (20) as set forth in claim 9 wherein said solar sides (110) extend past said housing side edges (68) and said solar ends (108) extend past said housing end edges (70) so that said solar top wall (102) fully covers (66) said top surface (30) of said housing (28).

* * * * *

UNITED STATES PATENT AND TRADEMARK OFFICE

CERTIFICATE OF CORRECTION

PATENT NO. : 8,556,475 B2
APPLICATION NO. : 13/322592
DATED : October 15, 2013
INVENTOR(S) : Hochstein It is certified that error appears in the above-identified patent and that said Letters Patent is hereby corrected as shown below:

In the specification column 5, line 16 "aim" should read "arm"

Signed and Sealed this
Fourth Day of February, 2014

Michelle K. Lee

Michelle K. Lee
*Deputy Director of the United States Patent and Trademark Office*